US006184499B1

(12) United States Patent
Antoine

(10) Patent No.: US 6,184,499 B1
(45) Date of Patent: Feb. 6, 2001

(54) PIVOTABLE HEATING ELEMENT FOR HOUSEHOLD ELECTRIC COOKING APPLIANCE

(75) Inventor: Dominique Antoine, Clourie (FR)

(73) Assignee: SEB S.A., Ecully (FR)

( * ) Notice: Under 35 U.S.C. 154(b), the term of this patent shall be extended for 0 days.

(21) Appl. No.: 09/510,224

(22) Filed: Feb. 22, 2000

(30) Foreign Application Priority Data

Feb. 19, 1999 (FR) ..... 99 02258

(51) Int. Cl.[7] ..... A21B 1/22; A47J 37/04; H05B 3/66

(52) U.S. Cl. ..... 219/404

(58) Field of Search ..... 219/404

(56) References Cited

U.S. PATENT DOCUMENTS

| | | | | |
|---|---|---|---|---|
| 2,918,560 | * | 12/1959 | Kruse | 219/404 |
| 3,024,346 | * | 3/1962 | Sand | 219/404 |
| 3,076,886 | * | 2/1963 | Altman et al. | 219/404 |
| 3,171,947 | * | 3/1965 | McOrlly | 219/404 |
| 3,197,615 | * | 7/1965 | Wetlesen | 219/404 |
| 3,221,140 | * | 11/1965 | Bisley et al. | 219/404 |
| 3,253,811 | | 5/1966 | Hanson . | |
| 3,296,417 | * | 1/1967 | Macaulay | 219/404 |
| 3,334,215 | * | 8/1967 | Allen | 219/404 |

FOREIGN PATENT DOCUMENTS

| | | | |
|---|---|---|---|
| 94 05 786 | | 8/1995 | (DE) . |
| 686368 | * | 12/1995 | (EP) . |

* cited by examiner

*Primary Examiner*—Joseph Pelham
(74) *Attorney, Agent, or Firm*—Pillsbury Madison & Sutro

(57) ABSTRACT

An electric cooking appliance composed of: a frame having at least one top or bottom wall and at least one lateral wall, the walls defining a cooking enclosure; and at least one tubular heating element arranged in the cooking enclosure, in the vicinity of at least one the top or bottom walls, the heating element being movable, by rotation, between a horizontal working position and a disengagement position with respect to the working position, wherein the heating element has two end parts whose free ends are connected by connectors to a current supply circuit for the heating element, the end parts extending out of the cooking enclosure through an opening or openings provided in one of the lateral walls, and at least one of the end parts has at least one locally enlarged portion which either: is able to cooperate with a fastener at least partially surrounding the heating element and forming an extremity of a restoring means for urging the heating element toward, and maintain said heating element in, the working position; or is located substantially adjacent the at least one lateral wall in order to limit translational or rotational lateral displacements of the heating element in directions different from the rotation of the heating element between the horizontal working position and the disengagement position.

14 Claims, 4 Drawing Sheets

PIVOTABLE HEATING ELEMENT FOR HOUSEHOLD ELECTRIC COOKING APPLIANCE

BACKGROUND OF THE INVENTION

The present invention relates to the field of electric cooking appliances of the household electric oven type or of the type utilized for grilling, broiling, barbecuing, etc., and concerns more particularly a pivotable heating element and its arrangement in such an appliance.

The patent document FR 2 720 917 discloses a heating element for a household electric oven which is movable through the intermediary of a guide element which permits the heating element to be displaced from a working position to a disengagement position by pivoting around a loop. If this solution is well adapted to a position of the heating element at the level of the bottom of the oven, it is in order, for an upper heating element, to provide a specific system for maintaining this heating element in a horizontal working position. Such systems are well known in the art.

Furthermore, the French patent document FR 2 752 918 describes a pivoting oven heating resistance, the assembly of the resistance being carried out with the aid of holes formed in each of the lateral walls, the resistance being mounted to be pivotable around a pivot axis located at those holes. Each hole carries a bearing block mounted in a fixed position, in which a bearing a sheath portion of the corresponding free end of the resistance is mounted as to permit pivoting of the resistance. An elastic means permits the resistance to be returned to its horizontal working position.

This solution is complex and requires several operations to connect the heating resistance to the elastic means. These operations are associated with a substantial cost. Furthermore, two lateral walls are required for pivoting of the resistance, which involves the provision of additional bulk.

BRIEF SUMMARY OF THE INVENTION

One of the objects of the present invention is to overcome drawbacks of the prior art by providing a pivoting heating element for an electric cooking appliance, which is simple to fabricate and to operate, and thus reduces fabrication costs, without reducing the performance of the heating elements, and all the while permitting a simple manipulation of the heating element by the user.

The present invention achieves the above and other objects by the provision of an electric cooking appliance comprising a frame having at least one bottom wall and/or at least one top, or roof, wall, at least one lateral wall, the walls defining a cooking enclosure, at least one tubular heating element arranged in the cooking enclosure, in the vicinity of the roof and/or the bottom wall of the electric appliance, the heating element being able to be positioned, by rotation, either in a horizontal working position or in a disengagement position with respect to the working position, an elastic restoring, or bias, means disposed between the heating element and the frame for permitting return of the heating element from its disengagement position, wherein the heating element has two end parts whose free ends are connected by connectors to a current supply circuit for the heating element, the end parts extending out of the cooking enclosure through an opening or openings provided in one of the lateral walls and each having at least one locally enlarged portion able to cooperate with a fastener at least partially surrounding the heating element and forming an extremity of the restoring means, the restoring means being arranged to urge the heating element toward, and maintain the heating element in, its working position.

The particular arrangement between the heating element and the restoring means is very simple in its implementation, requires few elements, and does not require any mechanical assembly means such as screws, soldering, etc. The assembly times are thus reduced and performance is achieved at minimum cost.

Advantageously, the enlarged portion, formed on each of the end parts of the heating element, is obtained by die forming the sheath, or insulating shield, of the heating element in a press.

This particularity permits fabrication of the device to be simplified. In effect, the die stamping creates a flattening of the heating element sheath, and consequently a transverse enlargement thereof, which enlargement serves to retain the elastic means preliminarily surrounding the heating element.

Advantageously, the end parts of the heating element are bent and have an inclination directed toward the restoring means. This permits the restoring means to always be positioned in abutment against the deformed zone of the heating element in order to provide the same torque on the heating element, which permits a reproducible positioning of the heating element into its working position.

BRIEF DESCRIPTION OF THE SEVERAL VIEWS OF THE DRAWING

The following drawing figures illustrate, by way of non-limiting example, preferred embodiments of the invention.

DETAILED DESCRIPTION OF THE INVENTION

The following detailed description will be presented with reference to an electric oven. However, it should be understood that the invention is not in any way limited to this particular use.

Figure 1:
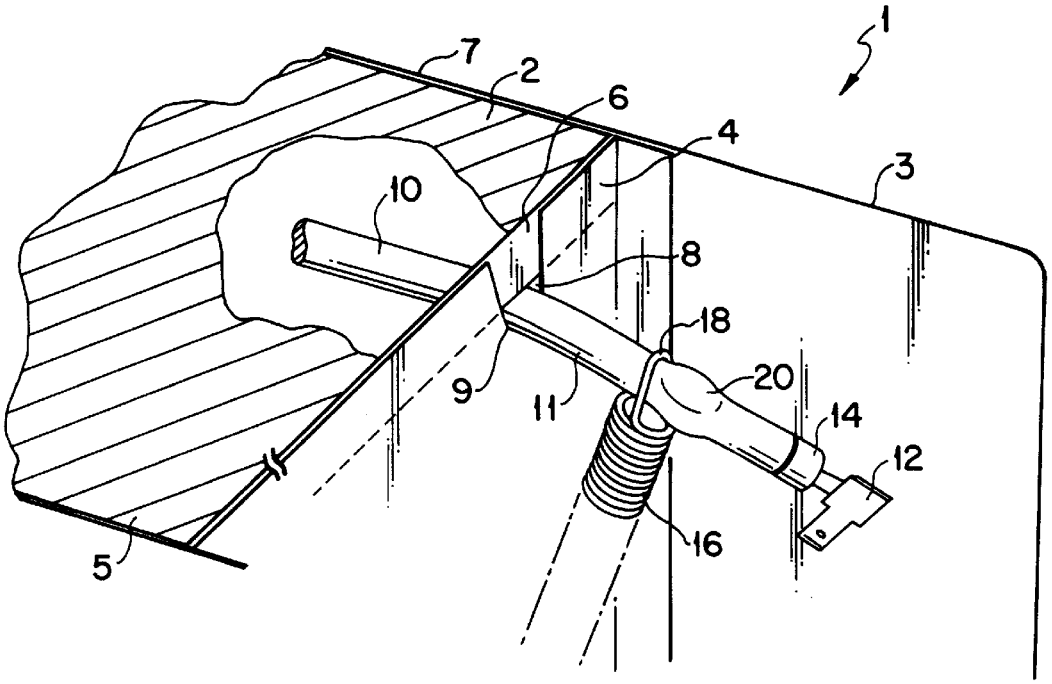
FIG. 1 is a perspective detail view of a portion of an oven equipped with an embodiment of the invention.

FIG. 1 shows an electric oven 1 composed of a frame 3. Frame 3 is composed of a roof 5 secured to two opposed lateral walls 4 (only one of which is shown) and/or a rear wall 7. Walls 4 and 7 and roof 5 form, together with a bottom wall (not shown) a cooking chamber 2. If desired, a front door (not shown) may be provided in order to create a closed cooking chamber.

A heating element 10 extends in a substantially horizontal plane in the vicinity of roof 5 when heating element 10 is in a working position, in which the electric appliance will be supplied with power in order to perform cooking operations.

Thus, the region below heating element 10 defines the cooking zone.

Figure 2:
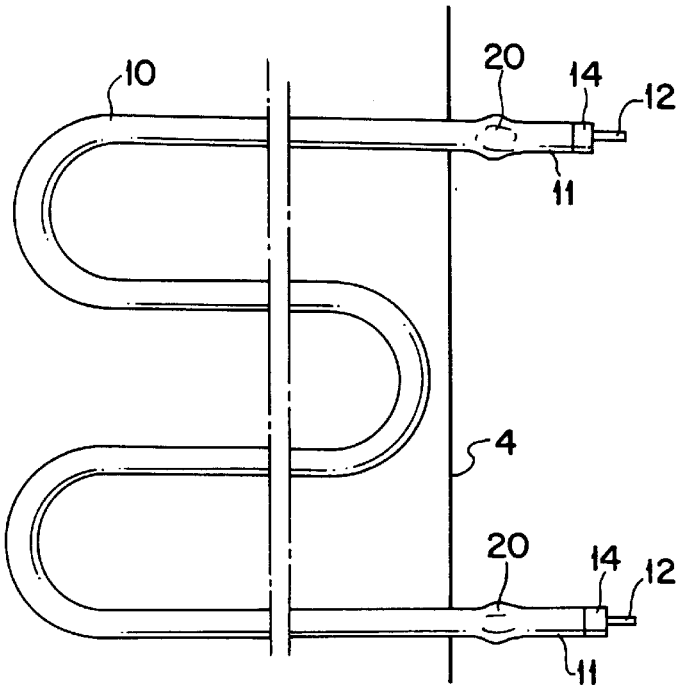
FIG. 2 is a top plan view showing the heating element of FIG. 1 installed in an oven.

According to the invention, one of the lateral walls 4 of the oven has openings 8 through which heating element 10 passes, as also shown in FIG. 2. This lateral wall 4 can be completed by a crosspiece 6 permitting the totality of the oven to be made suitably rigid.

As is shown most clearly in FIG. 2, heating element 10 follows a serpentine path in order to distribute radiated power as uniformly as possible.

The parts of heating element 10 which are located outside of the cooking chamber are designated by the reference numeral 11 and will be referred to herein as end parts. An end part is here intended to refer to a portion of heating element 10 which includes the very end thereof and a portion thereof extending from the end of the heating element up to lateral wall 4. The length of each end part can be 5%, or up to 10%, of the total length of the heating element.

These two end parts of heating element 10 are situated at the same side of one of the lateral walls and are substantially at the same height in the oven.

The free ends of these end parts are provided for electrical connections to heating element 10 by the intermediary of connection terminals, or lugs, 12 mounted on crimping rings 14 and connected to a power supply circuit (not shown), such as a power mains, for supplying current to heating element 10.

Furthermore, on at least one of these end parts 11 there are arranged elastic return, or biasing, means 16 for heating element 10. Means 16 may be constituted by a spring having one end connected to end part 11 as shown and its opposite end (not shown) connected to any stationary point of cooking chamber 2. Means 16 permit heating element 10 to occupy a horizontal working position, while offering the possibility, by urging of elastic return means 16, of pivoting heating element 10 in order to clean the roof, as illustrated, or the bottom wall, adjacent heating element 10.

The pivoting of heating element 10 occurs around a bearing point, or line, 9 for heating element 10, line 9 being defined by a portion of lateral wall 4 and being located at the level of opening 8 when heating element 10 is mounted as a lower heating element which is adjacent to the bottom wall of the cooking chamber when the cooking chamber is in use. Means 16 are constructed to produce a restoring force which is essentially in equilibrium with the downward pivoting force produced by the weight of heating element 10.

Return means 16, which can possibly be a spring as in the embodiment illustrated, or any other equivalent means, includes, at its end, an attachment element 18. This attachment element can have various forms, such as a hook, a collar, or a loop as shown in the illustrated embodiment. Attachment element 18 partially or completely surrounds tubular heating element 10, at the end part 11 and around a cross-sectional plane thereof. Complementing this loop, end part 11 of heating element 10 has a portion 20 which is enlarged in at least one transverse direction and serves to retain return means 16 in position relative to end part 11 when the device is placed into use.

The enlarged portion 20 can be created in different ways, either by the addition of a part which locally surrounds the heating element, or by deforming the heating element to the extent that its composition permits.

Figure 3A:
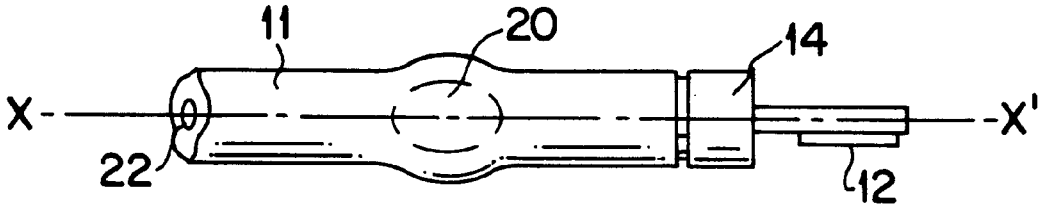
FIG. 3*a* is a detail elevational view of the end part of the heating element carrying an electrical connector.
Figure 3B:
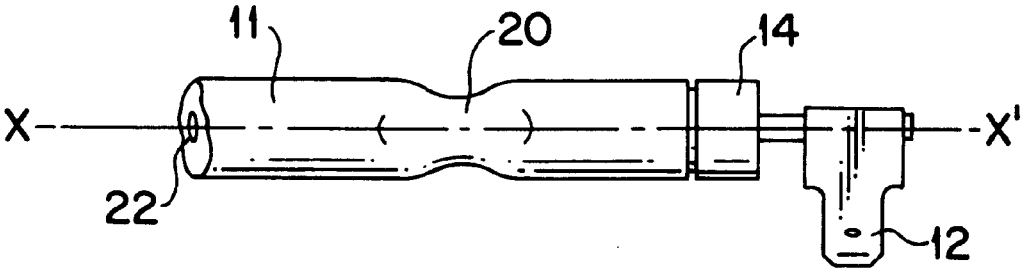
FIG. 3*b* is a detail view of the part shown in FIG. 3*a*, but taken in a plane which is perpendicular to the plane of FIG. 3*a* and which has been rotated about the axis X–X'.

In the example illustrated in FIG. 1, enlarged portion 20 is obtained by a die stamping operation which provokes a flattening of heating element 11 in one direction and, consequently, an enlargement in a direction transverse to the stamping direction, as is shown in particular in FIGS. 3*a* and 3*b*.

FIGS. 3*a* and 3*b* also illustrate the core, or conductor, 22 of heating element 10. During stamping, only the sheath of heating element 22 is slightly flattened in a manner such that conductor 22 will not be deformed or otherwise damaged. The heating element is preferably of the shielded, or sheathed type, i.e. it is constituted by a tube containing a coiled resistance wire enclosed by an insulating sheath made, for example, of magnesia.

Thus, element 18 of the return means cannot slide toward connector 12 and can only slide between enlarged portion 20 of heating element 10 and lateral wall 4 of oven 1. It is not, in effect, necessary to establish a fixed connection between these two elements, the return, or restoring, function being able to be effectuated with a rather great latitude on the lever arm utilized.

However, advantageously, end parts 11 of heating element 10 can be inclined toward the return means in order to assure that attachment element 18 tends to remain, by a systematic sliding, against enlarged portion 20. Thus, return means 16 exerts its force at the same location, reducing the same torque during successive manipulations of heating element 10 by the user. This particularity assures a reproducible and systematic positioning of the heating element in its working position and assures the horizontal orientation of the major portion of the heating element 10, i.e. the portion between end parts 11.

Another advantage to a bent form of end parts 11 relative to the remainder of heating element 10 is that it impedes sliding of heating element 10 through openings 8 when heating element 10 is composed only of a single loop.

Heating element 10 can thus be displaced or pivoted toward a position which makes the roof 5, in the case of the embodiment shown in FIG. 1, or the bottom wall, of cooking chamber 2 accessible in order to facilitate cleaning of the roof or bottom wall, the pivot angle being able to attain a value of up to 90° Thus, in the embodiment shown in FIG. 1, the main portion of heating element 10 would be pivoted downwardly while end parts 11 pivot upwardly, when cleaning is to be performed.

When heating element 10 is to be disposed adjacent the bottom wall of cooking enclosure 2, the orientation of return means 16 would be inverted relative to that illustrated in FIG. 1, or return means 16 can be eliminated.

It would be advantageous, when two heating elements are used, one under the roof and the other above the bottom wall, to connect return means for one of the heating elements to a lateral wall and to use the opposite lateral wall for connecting the return means of the other heating element. It is to be noted that only one lateral wall is needed to control the pivoting and the return of a heating element.

Another object of the invention relates to the guidance and maintenance of heating element 10. In effect, the freedom given to the heating element to be able to pivot in order to be disengaged from its working position should however be limited with respect to its lateral clearances, either in translation between two lateral walls, by sliding in opening 8 in the direction of arrow G of FIG. 4, or by pivoting about an axis perpendicular to the desired pivot axis, i.e. by movement of one side of heating element 10 relative to the other side in the direction between rear wall 7 and the front of cooking chamber 2, generally in the direction indicated by arrow F in FIG. 4.

In order to achieve the desired guiding, the present invention provides, on each of end parts 11, a second enlarged portion 30 formed in the same manner as enlarged portion 20, or in other words by addition of material to each end part 11 or by deformation. Enlarged portion 30 is located to be substantially adjacent lateral wall 4, thus preventing lateral movements of heating element 10 which could lead to dangerous contacts between connection terminals 12 and frame 3.

By extension, this principle of guiding and restricting clearances can be applied to any pivotable resistance, independently of the presence or not of a return means, thus independently of the problem of retaining a return means loop, such as loop 18, and/or of the location of the heating element in the cooking chamber, whether adjacent the roof or the bottom wall.

Figure 4:
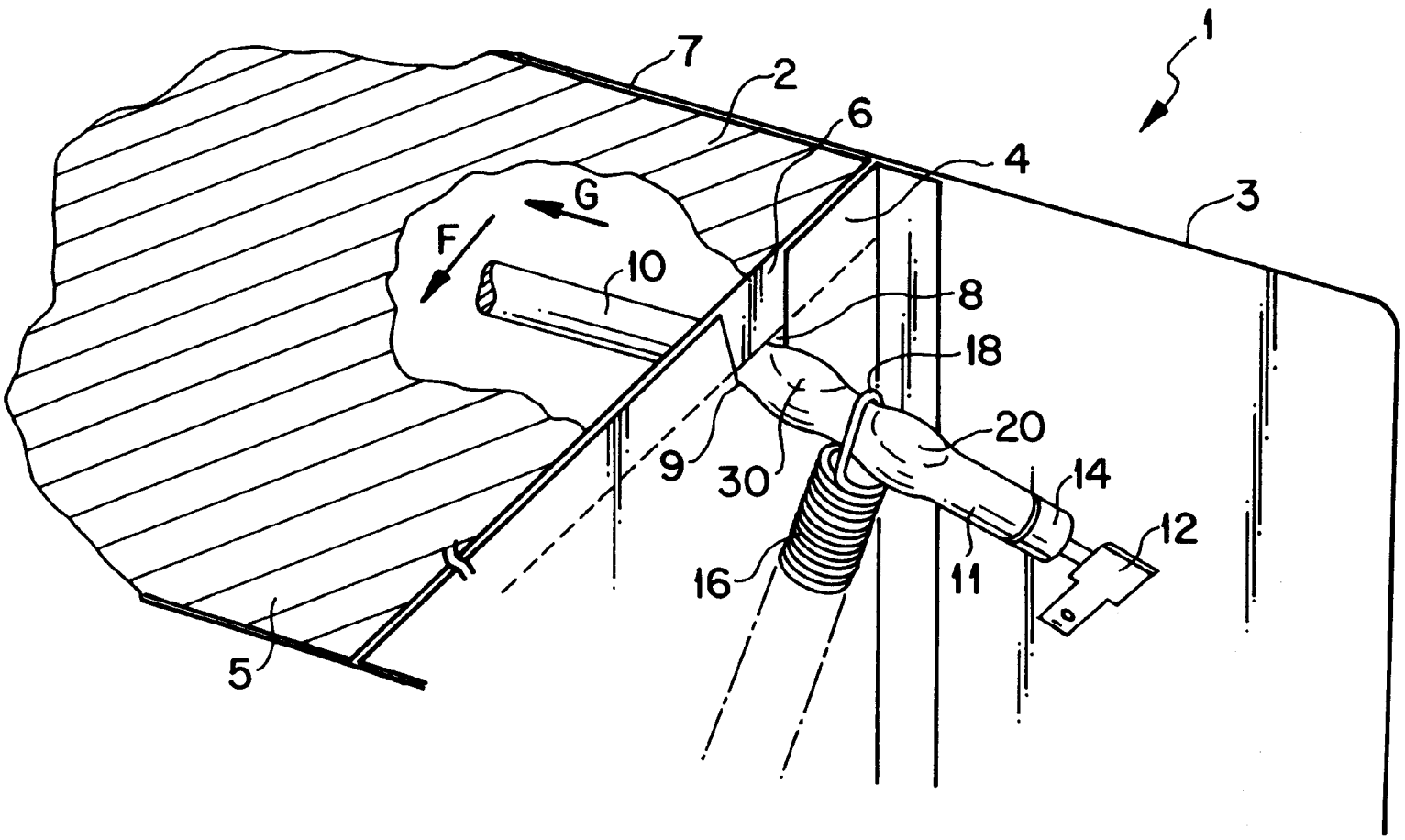
FIG. 4 is a view similar to that of FIG. 1 showing a second embodiment of a heating element according to the invention.

Particularly, when the heating element is adjacent the bottom wall, there is no need for a return means, since gravity will act to return the heating element to its horizontal position after it has been disengaged from its working position. An enlarged portion, such as portion 20, properly positioned, thus permits undesired lateral movements of the heating element to be avoided. Such an improvement according to the invention is shown in FIG. 4, which illustrates the added enlarged portion 30 on each end part 11 of heating element 10. According to the invention, enlarged portion 30 is located between loop 18 and lateral wall 4, and is preferably disposed immediately adjacent lateral wall 4. As noted above, enlarged portion 30 can be formed according to any of the procedures described above with respect to the formation of enlarged portion 20.

Advantageously, this function of lateral positioning of heating element 10 can be combined with that of guiding or maintaining loop 18 of return means 16, by a careful selection of the length of end parts 11 so that enlarged portion 30 will be situated substantially against lateral wall 4 when heating element 10 is in its working position. FIG. 4 shows this advantageous embodiment where loop 18 of return means 16 is maintained between enlarged portions 20 and 30. Thus, loop 18 can only slide on end part 11 between enlarged portions 20 and 30, which can be sufficiently close together to prevent any sliding movement of loop 18 along end part 11. Enlarged portions 30 also impede lateral movements of heating element 10 in the directions of arrows F and G of FIG. 4.

According to certain preferred embodiments of the invention, there can be provided on lateral walls 4 of the cooking appliance a means for retaining the, or each, heating element when it is positioned, by pivoting, away from its working position. These retaining means can be simple hooks or metallic clip elements or any other equivalent device. Cleaning of the roof and/or the bottom wall is then facilitated since the user does not have to maintain the heating element in its retracted position to proceed with the cleaning.

The electric cooking appliance to which the invention is applied can be advantageously constituted by an oven, a grill or a barbecue.

Figure 5:
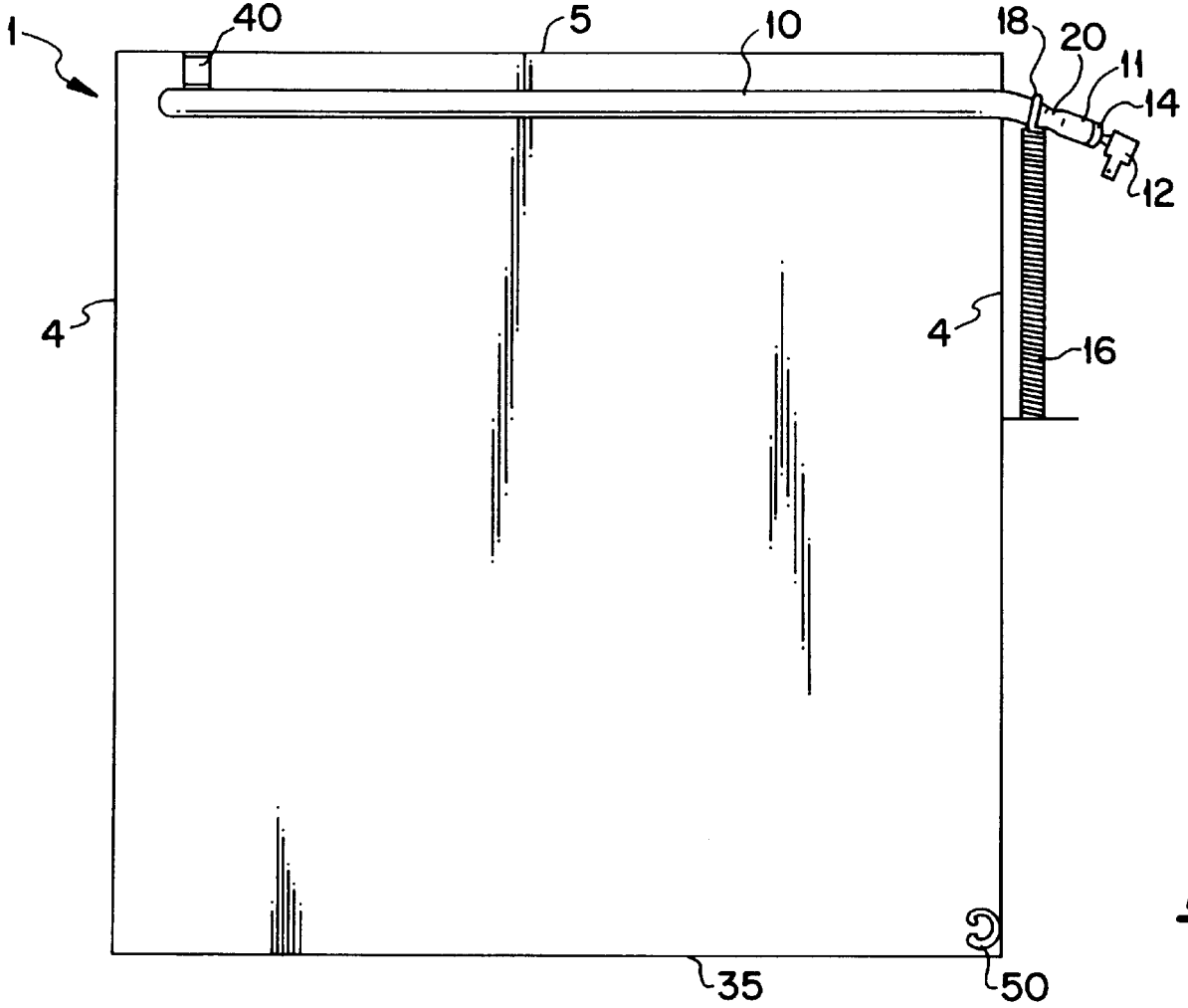
FIG. 5 is a simplified pictorial cross-sectional view showing the interior of the oven equipped with an embodiment of the invention.

FIG. 5 shows the interior of an oven which is enclosed by walls 4 and 5 as well as a bottom wall 35. The roof, or top wall, 5 is provided, at its downwardly facing surface, with a positioning element 40 against which heating element 10 bears to maintain the heating element in a horizontal orientation when the cooking appliance is in use. Preferably, element 40 would be made of a material which is a good electrical and thermal insulator.

As further shown in FIG. 5, the rear wall 4 through which heating element 10 extends may be provided with an elastic clip 50 which will engage a region at the free end of heating element 10 when heating element 10 has been deflected downwardly to facilitate cleaning of roof 5.

This application relates to subject matter disclosed in French Application number 99 02258, filed on Feb. 19, 1999, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An electric cooking appliance comprising:

a frame having at least one top or bottom wall and at least one lateral wall, the walls defining a cooking enclosure;

at least one tubular heating element arranged in the cooking enclosure, in the vicinity of said at least one top or bottom wall of said frame, said heating element being movable, by rotation, between a horizontal working position and a disengagement position with respect to the working position; and an elastic restoring means disposed between said heating element and said frame for urging said heating element from the disengagement position, wherein said heating element has two end parts whose free ends are connected by connectors to a current supply circuit for said heating element, said end parts extending out of the cooking enclosure through an opening or openings provided in one of the lateral walls, at least one of said end parts has at least one locally enlarged portion able to cooperate with a fastener at least partially surrounding the heating element and forming an extremity of said restoring means, and said restoring means being arranged to urge said heating element toward, and maintain said heating element in, the working position.

2. The appliance according to claim 1 wherein each of said end parts has at least one locally enlarged portion.

3. The electric cooking appliance of claim 1 wherein said at least one of said end parts has a second locally enlarged portion and the fastener is located between said first-recited enlarged portion and said second enlarged portion.

4. The electric cooking appliance of claim 3 wherein each of the said enlarged portions is formed by die stamping said at least one of said end parts in a press.

5. The electric cooking appliance of claim 4 wherein each of said end parts of said heating element is bent to be inclined toward said elastic restoring means when said heating element is in the working position.

6. The electric cooking appliance of claim 3 wherein each of said end parts of said heating element is bent to be inclined toward said elastic restoring means when said heating element is in the working position.

7. The electric cooking appliance of claim 1 wherein each of said end parts of said heating element is bent to be inclined toward said elastic restoring means when said heating element is in the working position.

8. The electric cooking appliance of claim 1 wherein said locally enlarged portion is obtained by stamping said heating element in a press.

9. An electric cooking appliance comprising:

a frame having at least one top or bottom wall and at least one lateral wall, the walls defining a cooking enclosure; and at least one tubular heating element arranged in the cooking enclosure, in the vicinity of said at least one top or bottom wall of said frame, said heating element being movable, by rotation, between a horizontal working position and a disengagement position with respect to the working position, wherein said heating element has two end parts whose free ends are connected by connectors to a current supply circuit for said heating element, said end parts extending out of the cooking enclosure through an opening provided in said at least one lateral wall, and at least one of said end parts has at least one locally enlarged portion located substantially adjacent said at least one lateral wall in order to limit translational or rotational lateral displacements of said heating element in directions different from the rotation of said heating element between the horizontal working position and the disengagement position.

10. The electric cooking appliance of claim 9 wherein said frame comprises at least one maintaining element for maintaining said heating element in the disengagement position.

11. The electric cooking appliance according to claim 9 wherein said cooking appliance is an electric oven.

12. The electric cooking appliance according to claim 9 wherein said cooking appliance is constituted by a grill.

13. The electric cooking appliance according to claim 1 wherein said cooking appliance is an electric oven.

14. The electric cooking appliance according to claim 1 wherein said cooking appliance is constituted by a grill.

* * * * *